US007255229B2

(12) United States Patent
Roesler

(10) Patent No.: US 7,255,229 B2
(45) Date of Patent: Aug. 14, 2007

(54) CASE FOR HOLDING ELONGATE OBJECTS

(76) Inventor: Peter Roesler, Ifenweg 3, D-88239 Wangen/Allgäu (DE)

( * ) Notice: Subject to any disclaimer, the term of this patent is extended or adjusted under 35 U.S.C. 154(b) by 0 days.

(21) Appl. No.: 11/340,283

(22) Filed: Jan. 26, 2006

(65) Prior Publication Data

US 2006/0169614 A1 Aug. 3, 2006

(30) Foreign Application Priority Data

Jan. 28, 2005 (DE) ..... 10 2005 004 253

(51) Int. Cl.
*B65D 85/28* (2006.01)

(52) U.S. Cl. ..... 206/379; 206/443

(58) Field of Classification Search ..... 206/372–379, 206/743, 745, 747–749, 443, 751, 755; 220/832, 220/843

See application file for complete search history.

(56) References Cited

U.S. PATENT DOCUMENTS

| | | | | |
|---|---|---|---|---|
| 3,074,539 | A * | 1/1963 | Rogovin | 206/379 |
| 3,346,733 | A | 10/1967 | Woolworth | |
| 3,870,149 | A * | 3/1975 | Huot | 206/379 |
| 4,006,821 | A * | 2/1977 | Sautter | 206/379 |
| 4,660,719 | A * | 4/1987 | Peterson et al. | 206/379 |
| 4,955,478 | A | 9/1990 | Rau et al. | |
| 5,490,975 | A * | 2/1996 | Dane | 206/379 |
| 5,746,316 | A * | 5/1998 | La Barre | 206/379 |
| 5,775,499 | A | 7/1998 | Budert | |
| 6,283,291 | B1 | 9/2001 | Vasudeva et al. | |
| 6,626,295 | B1 * | 9/2003 | Vasudeva | 206/373 |
| 6,915,900 | B2 * | 7/2005 | Chen | 206/379 |

FOREIGN PATENT DOCUMENTS

| | | |
|---|---|---|
| DE | 1 955 897 | 10/1966 |
| DE | 82 21 225 U1 | 12/1982 |
| DE | 38 37 829 C1 | 10/1989 |
| DE | 42 07 223 A2 | 9/1993 |
| DE | 295 13 388 U1 | 11/1995 |
| DE | 295 17 259 U1 | 2/1996 |
| DE | 298 05 740 U1 | 7/1998 |
| EP | 1 428 633 A1 | 6/2004 |

* cited by examiner

*Primary Examiner*—Luan K Bui
(74) *Attorney, Agent, or Firm*—Frederick L. Tolhurs, Esq.; Cohen & Grigsby, P.C.

(57) ABSTRACT

The invention relates to a case for holding elongate objects, in particular, drills or other tools, comprising a housing shell and a lid hinged pivotably thereto via a hinge and at least two pivotable holding parts which while the case is closed are pivoted inward into the interior, while they are pivoted outward out of the said interior when the lid is being opened, wherein only the holding part close to the lid is mounted in a pivoting axis in the housing shell of the case, while the at least one additional holding part disposed in front of the holding part closest to the lid is detachably connected to the respective closest holding part. The advantage lies in the fact that the case can be modularly expanded, that the manipulation is improved, and that the manufacturing cost is reduced.

40 Claims, 5 Drawing Sheets

CASE FOR HOLDING ELONGATE OBJECTS

CROSS REFERENCE

This application claims priority to German Patent Application No. 10 2005 004 253.8 filed Jan. 28, 2005.

BACKGROUND OF THE INVENTION

1. Field of the Invention

The subject of the invention is a case for holding elongate objects, in particular, a case for holding drills or other elongate tools or similar items.

Insofar as the present description of the invention mentions a "drill case", this is not to be understood as a restriction. The invention relates to a all cases suitable for holding elongate objects and having one holding part or a plurality of holding parts for this type of elongate objects, wherein upon opening of the lid the case is automatically pivoted upwards to offer the objects for removal.

When the description of the later exemplary embodiment calls the elongate objects "drills", this is not to be understood as a restriction. The invention therefore relates to all elongate objects suitable to be kept in a case of this type.

2. Description of the Prior Art

A case described above for holding elongate objects has become known to the art, for example, with the subject of the patent application DE 1 955 897 A1. Herein, a container for twist drills with a lid is described wherein two pivotable holding parts are pivoted inward into the interior when the case is closed and outward when the lid is being opened.

The two holding parts are interconnected by means of a spring so that they are pivoted by spring force into their open position when the lid is opened. When the lid closes, on the other hand, the spring force of the said two holding parts has to be overcome and they have to be manually held down while the lid is being closed, in order to succeed in closing the case.

A disadvantage of the said arrangement therefore lies in the complex manipulation and, coincidentally, in the risk that if the lid is not completely closed, the two spring-loaded holding parts act against the lid in the direction of opening thus opening the case unintentionally.

With the subject of the patent application DE 82 21 225 U1, an additional case of the type described above has become known to the art, wherein, however, fixed holding parts are provided, said holding parts being firmly integrated in the lid and pivoted therewith.

There is therefore the disadvantage that the elongate objects held therein are only accessible with difficulty when the case is opened. In this instance, it is required to reach into the cavity in the lid, in order to pull the objects upward and out. This means increased complication of operation.

With the subject of the patent application DE 38 37 829 C1, an additional case for storing elongate objects has become known to the art, wherein a plurality of holding parts is provided, said holding parts being disposed on a common pivoting axis and firmly connected to one another, wherein the holding part closest to the lid has a coupling to the pivotable part of the lid.

In this way, the advantage is obtained that when the lid of the case is opened, the holding parts are pivoted into a widely fanned position for the removal of objects, thereby making the objects to be removed easy to reach.

A disadvantage, however, lies in the fact that the case cannot be expanded without difficulty, since the holding parts form a single pivoting axis and are mounted rotatably on the said pivoting axis. It is therefore not possible, for example, to take out one holding part and to exchange it for another or to use more than three holding parts, because the holding parts described are all mounted in one common axis.

When using a larger number of holding parts (e.g. 3 holding parts as shown in the patent application DE 38 37 829 C1), the additional advantage arises that a relatively high pivoting weight acts upon the single pivoting axis of the holding parts, when the holding parts are loaded up with particularly heavy objects. In this process, the pivoting axis is stressed in a particular way and has to be designed with large dimensions. It therefore also is subject to a certain wear.

Furthermore, the manufacturing cost of a case of this type is relatively high, because it is made of a metallic material, which makes it particularly costly to manufacture. The holding parts all have lateral tongues located together on the single pivoting axis. This also leads to high manufacturing cost for the holding parts.

Another disadvantage coincidentally lies in the fact that the holding parts described are riveted into the single pivoting axis so that the holding parts are connected to the housing shell of the case via a single pivoting axis in a way that they cannot be detached.

This however entails the disadvantage that the case cannot be universally expanded; it is, for example, not possible to remove the holding parts and to exchange them for other holding parts.

Based on the patent application DE 38 37 829 C1, the invention thus relates to the object of refining a case for holding elongate objects of the type described above in such a way that it can be modularly expanded in an improved manner, that the manipulation is improved, and that the manufacturing cost is reduced.

The stated object is achieved according to the invention as characterized by the enabling disclosure of claim 1.

An essential feature of the invention lies in the fact that only the holding part close to the lid is mounted in a pivoting axis in the housing shell of the case, while the additional holding parts disposed in front of the holding part closest to the lid are connected to the respective closest holding part in such a way that they can be detached and optionally pivoted.

The enabling disclosure given leads to the substantial advantage that only the holding part closest to the lid forms a pivoting axis in the housing shell of the case, while the remaining holding parts located in front thereof no longer form an independent pivoting axis with the housing-side pivoting axis. Rather, the invention provides for the said additional holding parts attached in front of the holding part closest to the lid to be connected detachably to the respective holding part, preferably via snap-on connections.

In this way, a so-called "piggyback principle" is protected, which means that only the holding part closest to the lid has a common pivoting axis with the housing shell, while all remaining holding parts are connected to the said holding part closest to the lid in a way to be detachable and, if warranted, also pivotable.

When using two holding parts, therefore, the frontal holding part is pivotably connected and detachably to the holding part closest to the lid.

When using three holding parts, the central holding part is—as described earlier—pivotably connected and detachably to the holding part closest to the lid, while the most frontal holding part is pivotably connected and detachably to the central holding part.

The parts thus are connected to one another in the sense of the above described piggyback solution.

This results in the advantage that the holding parts are easily and universally exchangeable, since a refinement provides that the holding part closest to the lid is mounted detachably in the pivoting axis on the housing shell.

In this way, a snap-on connection is created permitting the holding part closest to the lid to be quickly taken from the housing and exchanged for another.

In this context, coincidentally, for one refinement it is preferred to have all parts (case shell, lid, holding parts, and the pertaining elements) constructed from a synthetic material. The use of synthetic materials has the substantial advantage that it becomes possible to save on separately mountable parts. Therefore, for the present exemplary embodiment it is preferred to provide that the carrier plate (bracket) linked to the upper pivotable end of the holding part closest to the lid be connected as single-material to the said holding part via a film hinge.

Equally it is preferred to have the connection between the said carrier plate and the lid designed as snap-on connection so that the holding part closest to the lid can easily be removed from the housing and exchanged by another one.

The same features are also present for the remaining piggyback holding parts disposed detachably on the frontal side of the respective subsequent holding part detachable.

A first embodiment provides that the said holding parts are snapped onto the respective preceding holding part in a way to be simply detachable and not pivotable, which results in a particularly simple snap-on connection.

One refinement of the invention, however, provides that the said holding parts be linked to the respective preceding holding part in the form of a pivotable snap-on connection so that they are linked to the respective preceding holding part in the sense of the described piggyback solution in a way to be easily detachable, though pivotable.

In this way, a modular structure of the case results, wherein all holding cases are easily exchangeable so that, depending on the particular application, it will be sufficient to dispose one holding part or a plurality of holding parts, and, depending on the particular application, a plurality of holding parts can still be added, because all holding parts hang detachably together.

SUMMARY OF THE INVENTION

The subject of the present invention ensues not only from the subject of the individual patent claims, but also from the combination of the individual patent claims with one another.

All data and features disclosed in the documentation, including the abstract, in particular, the spatial structure represented in the drawings, are claimed as substantial for the invention insofar as they are novel individually or in combination as compared to the prior art.

BRIEF DESCRIPTION OF THE DRAWINGS

The invention is explained in detail herebelow with reference to drawings representing only one way of carrying out the invention. In this context, additional substantial features and advantages of the invention become evident from the drawings and their descriptions.

DESCRIPTION OF A PRESENTLY PREFERRED EMBODIMENT OF THE INVENTION

Figure 1:
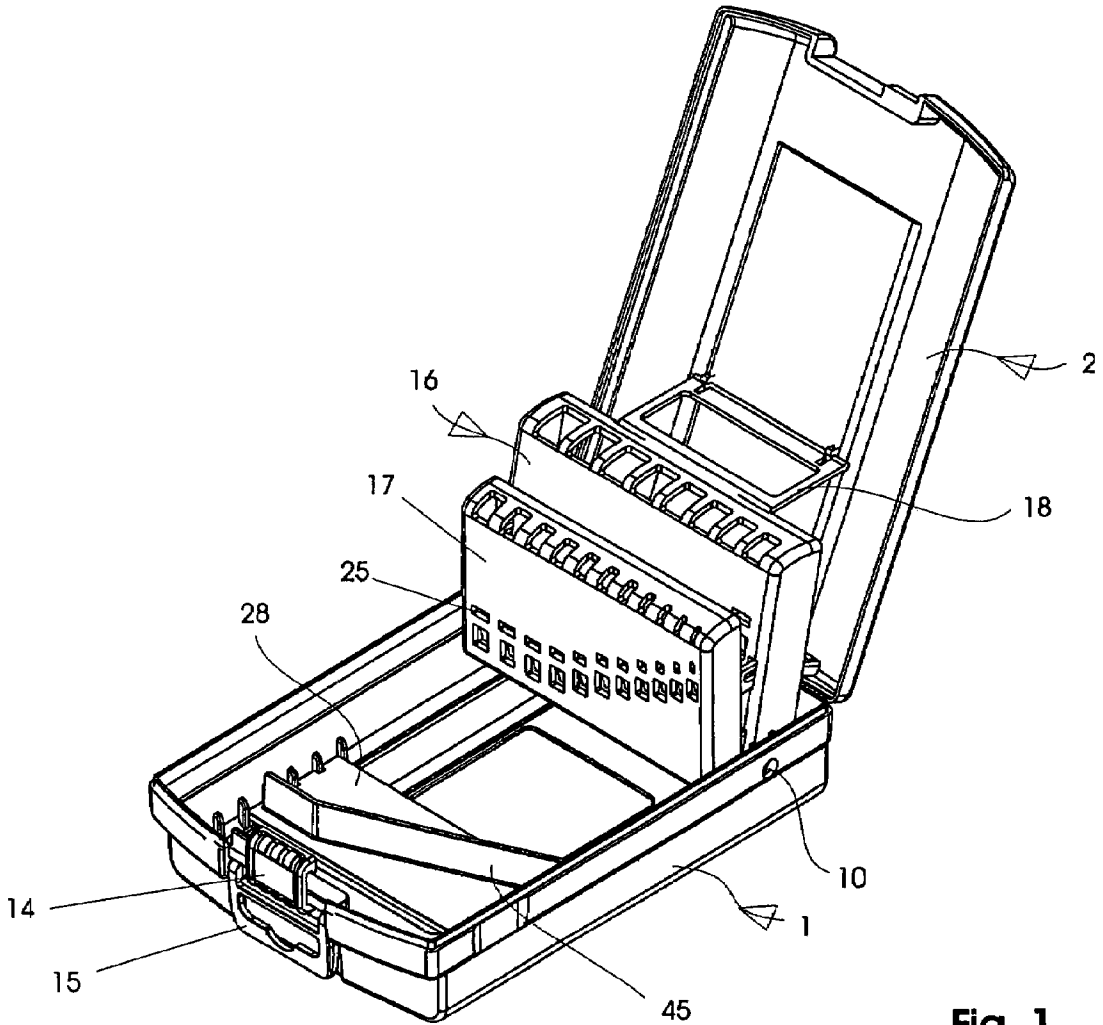
FIG. 1: shows a schematic representation of a case in open position.

The case according to FIG. 1 is manufactured—as detailed earlier—from all-plastics material, wherein preferably an ABS material is used for the material of the housing shell 1 and the lid 2, while a polypropylene is used for the holding parts 16, 17.

The use of all-plastics material for all components leads to the additional important aspect that this kind of a completely filled drill case may drop from a height of two meters onto hard ground without incurring damage to the housing, the content, or the holding parts 16, 17.

Due to the use of a special slide closure 14 between the lid and the housing shell, coincidentally, an unintended opening of the lid 2 is prevented in this extreme example, as well.

The lid 2 is hinged pivotably to the rear side of the housing shell 1 via two hinges 3 disposed in parallel.

When in the following description only one half of the housing and the lid are described, this is not to be understood as a restriction, since all parts are disposed fully symmetrical to the longitudinal center axis of the entire arrangement so that it will be sufficient for reasons of simplicity to describe only one side, as the opposite side is constructed identically.

The hinge 3 comprises a holding pocket 4 molded onto the interior of the lid and an additional holding pocket 5 molded onto the interior wall of the housing shell 1.

A plastic hinge 6, preferably manufactured of a polyamide material, is introduced into the said two holding pockets 4, 5. The plastic hinge 6 thus forms a pivoting axis 7 designed as film hinge.

A snap-on device 8 for the carrier plate 18 of the holding part 16 closest to the lid is disposed on the interior of the lid 2, wherein a matching snap-on element 19 respectively snaps onto the matching snap-on device 8 on the lid 2 on the carrier plate 18 and is retained there in a way to be detachable.

Instead of a bracket-shaped carrier plate 18, it is also sufficient to use only individual struts so that then the c-shaped central part of the bracket may also be omitted.

The upper, pivotable part of the lid 2 is to be provided with an indentation 9 with a retaining nose 46 disposed in the area of the said indentation 9, said retaining nose 46 being fitted into an indentation 47 on the housing shell 1 and being able to be enclosed by an approximately c-shaped slide closure 14 when the slide closure 14 is in closed position.

It is now of importance that the pivoting axis 21 between the holding parts 16, 17 and the housing shell 1 is formed only by the holding part 16 closest to the lid, said holding part 16 having an axis stub 30 on each of its two opposite lateral walls, which stub 30 is held detachably in the respective snap-on device 10 on the housing shell 1.

The snap-on device 10 here comprises a bore in the lateral wall of the housing shell 1, while conical guide ribs 12 are oriented toward the said bore so that a simple engagement of the two axis stubs 30 disposed in opposite directions on the lateral walls of the holding part 16 with the opposite bores in the area of the snap-on device 10 is ensured.

The floor of the housing shell 1 is provided with two upward-pointing, parallel stop ribs 11 serving to limit the opening pivoting angle of the holding part 16 backward in the direction of the lid 2.

In the frontal area of the floor of the housing shell 1, close to the lateral walls, a plurality of stop ribs 13 are disposed at a distance from one another, said stop ribs 13 acting in conjunction with a length stop 28 mounted onto the housing shell 1 as separate part with the possibility of being mounted in various positions into the housing shell 1, in the direction of the longitudinal layout of the housing shell 1, in order to thereby form a longitudinal stop for the elongate objects inserted into the holding parts.

Coincidentally, a hanging device 15 is pivotably mounted on the frontal area of the housing shell 1 so that it is possible to hang the entire case onto a hanging surface.

The carrier plate 18 forming the pivoting guidance of the holding part 16 closest to the lid is preferably applied by spraying onto the holding part 16 and forms a film hinge in the area of the pivoting axis 20.

According to the present description of the invention, it is of importance that additional holding parts 17, 37 are snapped onto the holding part 16 closest to the lid in the form of "piggyback" bracings and are pivotably connected thereto.

For this purpose, additional details of the said pivoting snap-on feature are described with reference to FIGS. 2 through 4.

Figure 3:
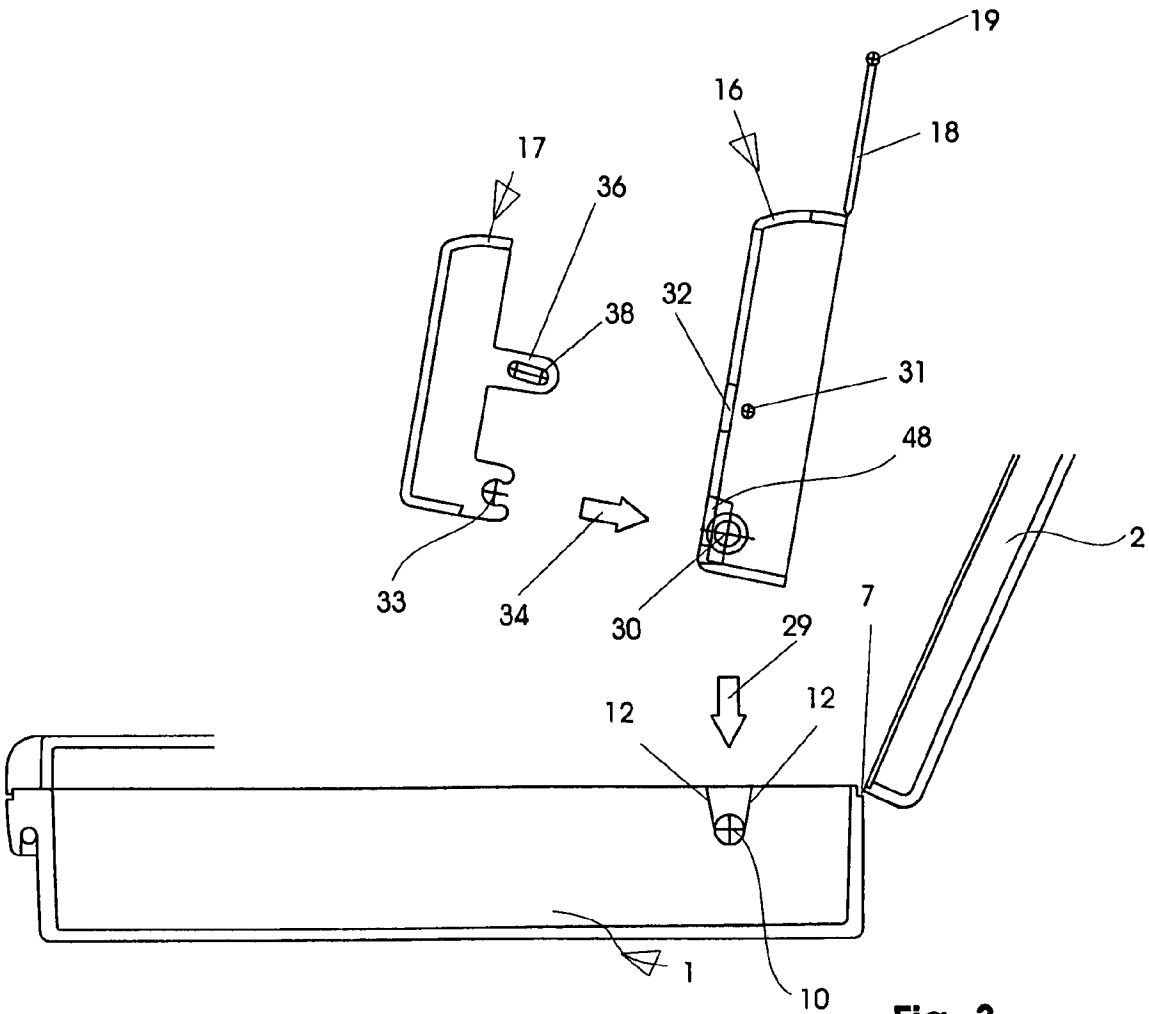
FIG. 3: shows a schematic arrangement according to FIG. 2 during the mounting of the holding parts.

According to FIG. 3, the holding part 17 has a lower snap-on device 33 oriented toward the holding part 16 closest to the lid, which snap-on device can engage with an axis stub 40 (see FIG. 4) on the interior side of the holding part 16.

In this manner, the holding part 17 is guided in the direction of the arrow 34 toward the holding part 16 closest to the lid, and the snap-on device 33 at first snaps onto the axis stub 40.

In order now to achieve a pivoting guidance, it is further provided to dispose a tongue 36 on the pivotable part of the holding part 17 with an elongated hole 38 worked into the area of the said tongue 36.

The said elongated hole engages with a snap-on nub 31 in turn located on the interior side of the lateral wall of the holding part 16. The tongue 36 here reaches through a slot 32 in the frontal wall of the holding part 16.

In the same way, the snap-on device 33 also reaches through a slot 48 in the frontal wall of the holding part 16, in order to engage with the axis stub 40 (see FIG. 4) located therebehind.

Figure 4:
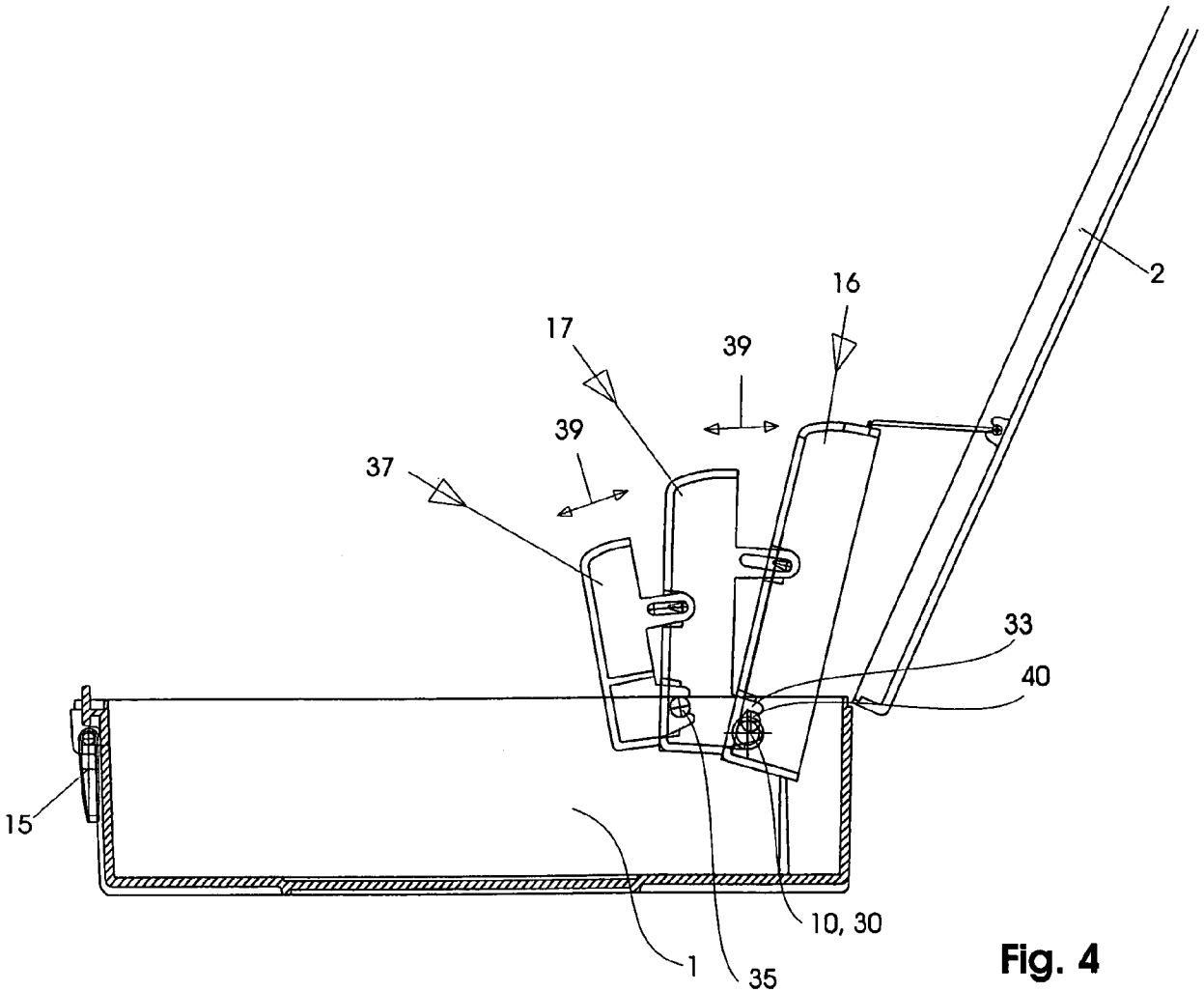
FIG. 4: shows an embodiment of a case as modified in relation to FIGS. 1 through 3 with a total of three holding parts.

This results in pivoting mountings as represented in FIG. 4. The holding part 17 thus is mounted in such a way that it can be pivoted in relation to the holding part 16 in direction of the arrows 39, and in the same way, an additional holding part 37 can now also be snapped onto the central holding part 17 in the sense of the piggyback solution described above. Consequently, the same explanations as given with regard to the attachment of the holding part 17 to the holding part 16 with reference to FIG. 3 are applicable in this context.

Here, an axis stub 35 engaging with the matching snap-on device on the holding part 37 is present in the same way on the respective interior lateral surface of the holding part 17.

The simplicity of the mounting of various holding parts ensues from a comparison of FIGS. 3 and 4. It becomes clear that, for example, the holding part 37 can easily be removed from the holding part 17, in order to be able to hold different objects than held in a comparably tightly packed case, when a total of three holding parts 16, 17, 37 are present.

Figure 5:
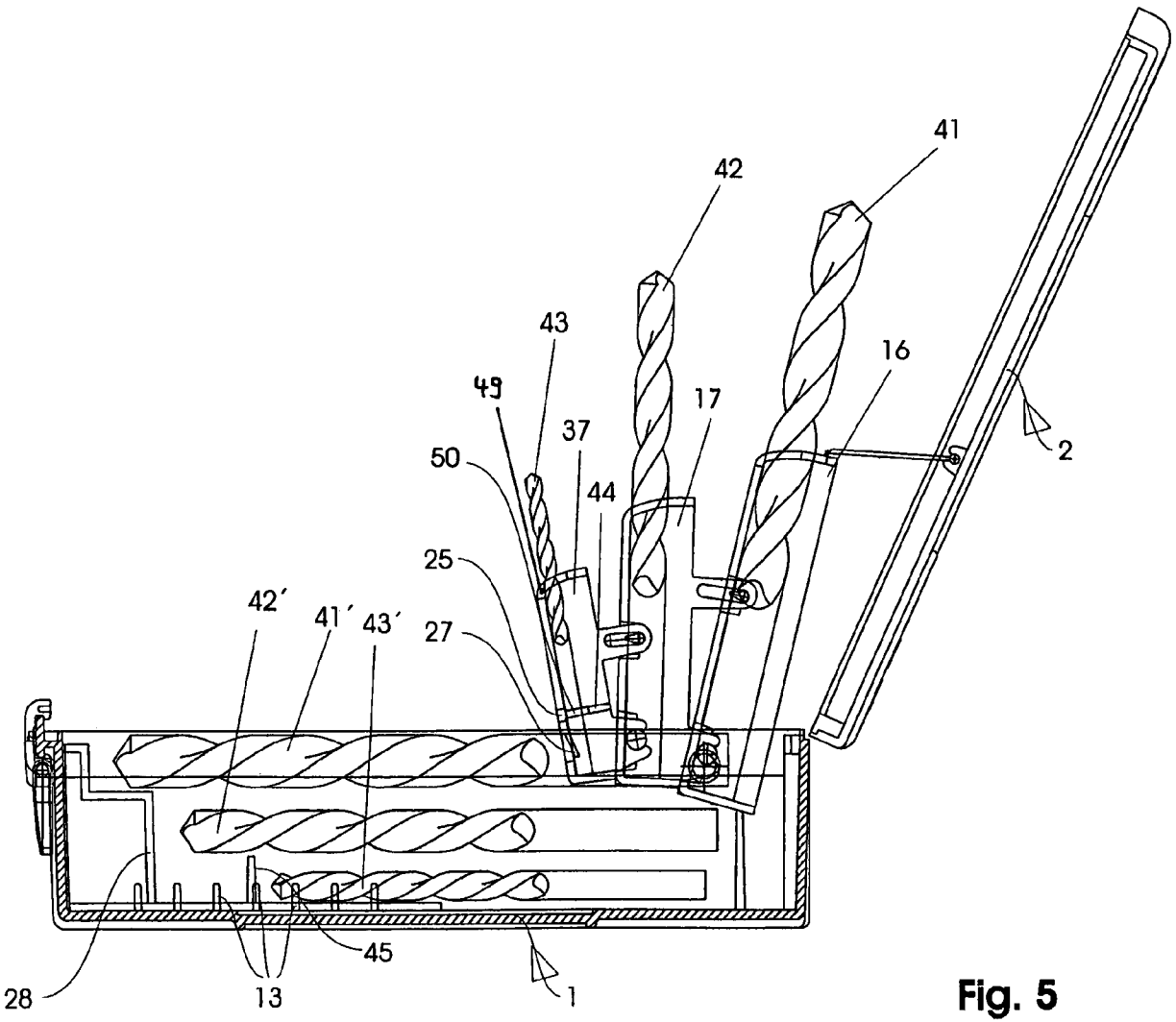
FIG. 5: shows a lateral view of the arrangement according to FIG. 4 with a completely filled case.

A completely filled drill case with three completely filled holding parts is shown in FIG. 5.

The particular bracing of the objects is herein of particular importance. This will be explained in more detail with reference to the drills 41, 42, 43.

It is stated only in exemplary manner with reference to the example of the holding part 37 that the drill 43 reaches through an upper slot 49 of the holding part 37 and there reaches through an additional lower slot 50 in the area of a retaining link 44, wherein for reasons of synthetic material technology, the said retaining link 44 forms a breakthrough 25 in the frontal wall of the holding part 37.

Figure 2:
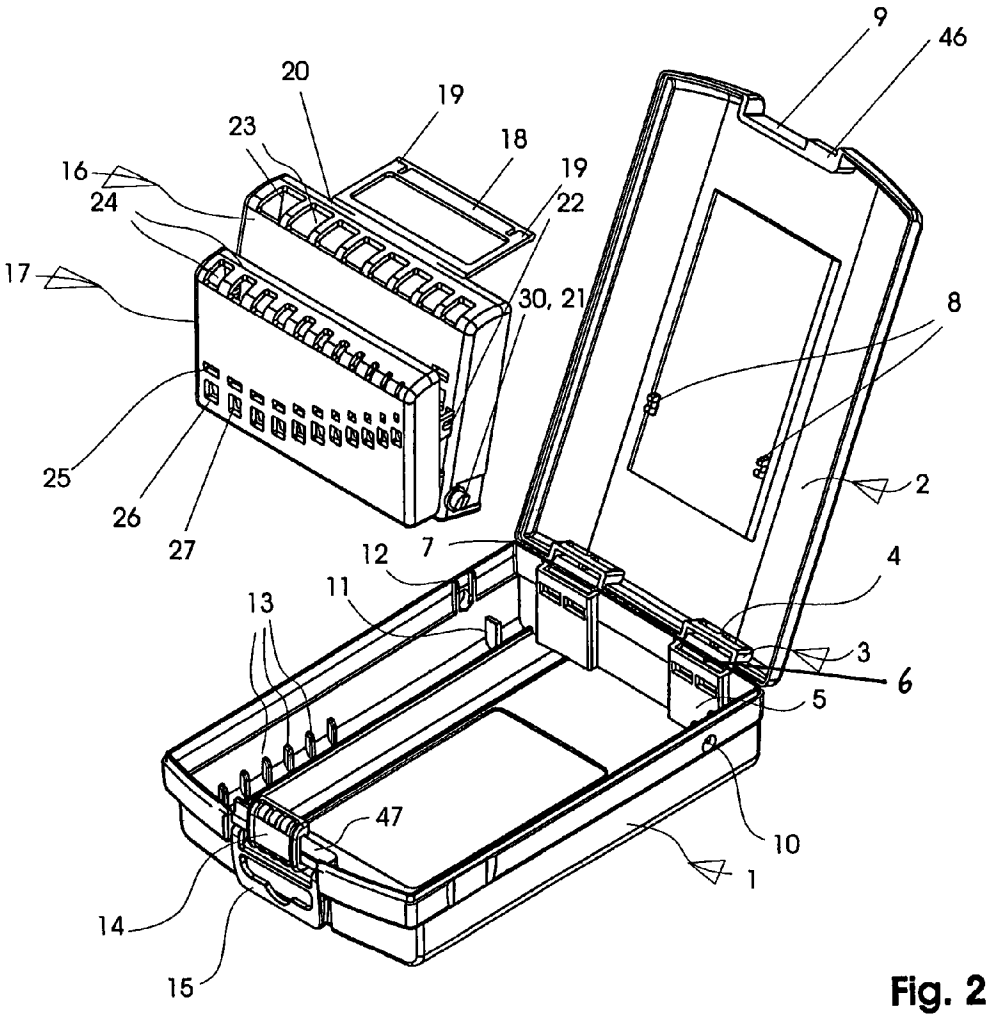
FIG. 2: shows a schematic representation according to FIG. 1 with holding parts removed.

The said breakthroughs 25, for example, are also shown in FIG. 2.

In the area of breakthroughs 26, disposed further down, inward-pointing, resilient clamping tongues 27 are constructed therein and protrude into the insertion path of the respective drill 41-43, thereby clamping in and retaining the said drill 41-43.

This describes a displacement-free and clearing-free storage of the respective drill 41-43.

When the case is in closed position, the said drills 41-43 therefore cannot rattle nor move any more.

The blockage of a longitudinal displacement is further provided by the aforementioned length stop 28 having the capability of being disengaged and removed and mounted in various longitudinal positions in the housing shell 1.

A mounting example of this kind is shown in FIG. 5, where it can be seen that the lowest drills 43' come to rest against the longitudinal stop 45 of the length stop 21, while the additional drills 42' lying thereabove and assigned to the holding part 17 come to rest against additional stops of the length stop 28.

In this way, each drill 41, 42, 43 is inserted into the corresponding holding openings 23, 24 of the respective holding part 16, 17.

The pivoting arrangement of the individual holding parts 17, 37 in the form of snap-on means 22 thus permits to bring the drills 41-43 into a convenient removal position according to FIG. 5.

The universal exchangeability of the holding parts 16, 17, 37 results from the fact that now for removing all holding parts, it is sufficient to dissolve the snap-on connection between the holding part 16 closest to the lid and the housing shell 1 in the area of the snap-on device 10 generated in the direction of the arrow 29 according to FIG. 3.

With the removal of the holding part 16 thus all additional holding parts 17, 37 hanging thereon are also removed.

This results in the universal usability of a case according to the invention, since the holding parts can be adapted to different objects to be kept by simply exchanging holding parts.

In comparison to the tin cases known to the art, the case according to the invention is lighter by approximately 20 to 30%, which means a substantial reduction of weight. Since the surfaces of the case are relatively soft synthetic material surfaces, the case is also safer to operate and manipulate and can be placed on any surface without fear of slipping.

Of course, the top of the lid 2 and the underside of the housing shell 1 are provided with corresponding stacking grooves so that a plurality of cases can be stacked upon one another without being able to slide.

Due to the use of a hinge 6 made of synthetic material in the area of the holding pockets 4, 5, the substantial advantage is obtained that the rear end wall of the housing wall 1 and the corresponding wall of the lid 2 are completely flat and do not have any protrusions so that the case according to the invention can also be placed on the rear end wall of the housing, thus being placed on a surface in a safe vertical position. This will not be possible with the conventional tin cases, because these have hinge arrangements protruding beyond the rear end wall.

The piggyback arrangement of the frontal holding parts 17 and 37 on the holding part 16, which is mounted on the housing side in a pivoting axis 10, 30 also results in a particularly convenient removal position for the elongate objects disposed in the holding parts 17 and 37.

If then the lid 2 of the housing 1 is completely opened, the linkage of the holding part 16 to the lid with the carrier plate 18 is designed in such a way that the holding part moves into a reclined removal position.

The objects therefore are particularly easy to remove from the frontal removal part 16. However, in order to enlarge the removal space above the additional holding parts 17 and 37, the possibility is provided to have the said additional holding parts 17 and 37 use their tongues and the snap-on nubs disposed thereon to swivel into a swiveling motion to the left in the direction of the arrow 39. In this way, the said holding parts 17 and 37 move into a position at a certain angle to the previously described holding part 16, and, due to the relatively heavy, elongate objects such as drills or similar items disposed in the said holding parts 17 and 37, this motion occurs automatically based on the force of gravitation.

Due to this particular pivoting linkage of the holding parts 17 and 37, therefore, the holding parts 17 and 37 perform a weight-based complete pivoting opening movement away from the holding part 16, which results in a particularly convenient and open removal position for all three holding parts.

The design of the case with holding parts forming a piggyback linkage thus has not only the advantage of the cost-effective manufacture, the better and wear-resistant mounting, but also the additional advantage that a weight-loaded, convenient removal position is created for all three holding parts 16, 17, 37.

LEGEND FOR THE DRAWINGS

1 housing shell
2 lid
3 hinge
4 holding pocket (upper)
5 holding pocket (lower)
6 plastic hinge
7 pivoting axis
8 snap-on device
9 indentation
10 snap-on device
11 stop rib
12 guide rib
13 stop ribs
14 slide closure
15 hanging device
16 holding part (rear)
17 holding part (front)
18 carrier plate
19 snap-on element
20 pivoting axis (upper)
21 pivoting axis (lower)
22 snap-on means
23 holding openings
24 holding openings
25 breakthrough (upper)
26 breakthroughs (lower)
27 clamping tongue
28 length stop
29 direction of arrow
30 axis stub
31 snap-on nub
32 slot
33 snap-on device
34 direction of arrow
35 axis stub
36 tongue
37 holding part
38 elongated hole
39 direction of arrows
40 axis stub
41 drill
42 drill
43 drill
44 retaining link
45 longitudinal stop
46 retaining nose
47 indentation
48 slot
49 slot
50 slot

What is claimed is:

1. A case for holding elongate objects, said case comprising:

a housing shell;

a lid that is pivotally connected to said housing shell by a hinge, and;

at least three pivotable holding parts that are swiveled inward into the interior of the case at times when the case is closed and that are swiveled outward from the interior of the case at times when the lid is being opened, wherein;

a first holding part that is closest to the lid includes a nub and an axis stub, said first holding part being mounted to the housing shell on said axis stub and wherein;

at least a second holding part is disposed on the side of the first holding part that is away from said lid, said second holding part having an axis stub and a nub disposed thereon, said second holding part also having a snap-on device that engages the axis stub of the first holding part to detachably connect the second holding part to said first holding part, said second holding part also having a tongue with an elongated hole that slidingly engages the nub of the first holding part and wherein;

at least a third holding part is disposed on the side of the second holding part that is away from said first holding part, said third holding part also having a snap-on device that engages the axis stub of the second holding part to detachably connect the third holding part to said second holding part, said third holding part also having a tongue with an elongated hole that slidingly engages the nub of the second holding part.

2. A case according to claim 1 wherein said second holding part is pivotably connected to the first holding part.

3. A case according to claims 1 or 2 wherein the second holding part is connected to the first holding part by at least one snap-on connection that can be repeatedly attached and detached.

4. A case according to claims 1 or 2 wherein a carrier plate connects the first holding part to the interior of the lid.

5. A case according to claim 4 wherein the carrier-plate is a u-shaped bracket or an O-shaped bracket.

6. A case according to claim wherein the carrier plate is pivotably linked to the upper end of the first holding part.

7. A case according to claim wherein the carrier plate is constructed of synthetic material and is connected to the first holding part as single material by a film hinge.

8. A case according to claims 1 or 2 wherein the connection between the carrier plate and the lid is a snap-on connection that can be repeatedly attached and detached.

9. A case according to claims 1 or 2 wherein the first holding part has two opposite lateral walls, each of said lateral walls having an axis stub that is held in a matching snap-on device that is located in the housing shell.

10. A case according to claim 9 wherein the snap-on device is a bore in the lateral wall of the housing shell.

11. A case according to claim 10 wherein conical guide ribs are oriented toward the bore so that the two counter-directed axis stubs engage the opposing bores in the lateral walls of the housing shell.

12. A case according to claims 1 or 2 wherein the housing shell includes a floor having at least one upward-pointing, parallel stop rib, said stop rib limiting the opening pivoting angle of the first holding part toward the rear in the direction of the lid.

13. A case according to claims 1 or 2 wherein a plurality of stop ribs disposed at a distance from one another are provided in the frontal area of the floor of the housing shell, close to at least one of the lateral walls, said case further including a length stop that is adjustably mounted at selected positions along the major dimension of the housing shell, said length stop cooperating with said stop ribs to form a longitudinal stop for elongate objects that are inserted into the holding parts.

14. A case according to claims 1 or 2 wherein the second holding part has one lower snap-on device that is oriented toward the first holding part, said snap-on device engaging an axis stub on the interior side of the first holding part, said snap-on device extending through a slot in the frontal wall of the first holding part.

15. A case according to claims 1 or 2 wherein a tongue is disposed on the upper pivotable part of said second holding part, said tongue having an elongated hole that snaps onto a snap-on nub that is on the interior side of the lateral wall of the first holding part, said tongue extending through a slot in the frontal wall of the first holding part.

16. A case according to claims 1 or 2 wherein the first and second holding parts further include lower breakthroughs, said first and second holding parts also having a plurality of slot pairs, with the upper and lower slots being disposed in series in the insertion direction of the tools, and with the lower slots being disposed in the area of a retaining link, and wherein inward-pointed, resilient clamping tongues are constructed in the area of the lower breakthroughs, said clamping tongues protruding into the insertion path of the respective drill and clamping the drill into place.

17. A case according to claims 1 or 2 wherein at least the housing shell, the lid, and the first and second holding parts are constructed from a synthetic material.

18. A case according to claim 17 wherein the housing shell and the lid are constructed from ABS material, and the first and second holding parts are constructed from polypropylene.

19. A case according to claims 1 or 2 wherein the hinge between the housing shell and the lid comprises a film hinge that is made of polyamide.

20. A case for holding elongate objects, said case comprising:

a housing shell;

a lid that is pivotally connected to said housing shell by a hinge, and;

at least two pivotable holding parts that are swiveled inward into the interior of the case at times when the case is closed and that are swiveled outward from the interior of the case at times when the lid is being opened, wherein;

a first holding part that is closest to the lid includes a nub and a first axis stub and a second axis stub, said first holding part being mounted to the housing shell on said axis stubs and wherein;

at least a second holding part is disposed on the side of the first holding part that is away from said lid, said second holding part having an axis stub and a nub disposed thereon, said second holding part also having a snap-on device that engages the second axis stub of the first holding part to detachably connect the second holding part to said first holding part, said second holding part also having a tongue with an elongated hole that slidingly engages the nub of the first holding part.

21. A case according to claim 20 wherein said second holding part is pivotably connected to the first holding part.

22. A case according to claims 20 or 21 wherein the second holding part is connected to the first holding part by at least one snap-on connection that can be repeatedly attached and detached.

23. A case according to claims 20 or 21 wherein a carrier plate connects the first holding part to the interior of the lid.

24. A case according to claim 23 wherein the carrier-plate is a u-shaped bracket or an O-shaped bracket.

25. A case according to claim 23 wherein the carrier plate is pivotably linked to the upper end of the first holding part.

26. A case according to claim 23 wherein the carrier plate is constructed of synthetic material and is connected to the first holding part as single material by a film hinge.

27. A case according to claims 20 or 21 wherein the connection between the carrier plate and the lid is a snap-on connection that can be repeatedly attached and detached.

28. A case according to claims 20 or 21 wherein the first holding part has two opposite lateral walls, each of said lateral walls having an axis stub that is held in a matching snap-on device that is located in the housing shell.

29. A case according to claim 28 wherein the snap-on device is a bore in the lateral wall of the housing shell.

30. A case according to claim 29 wherein conical guide ribs are oriented toward the bore so that the two counter-directed axis stubs engage the opposing bores in the lateral walls of the housing shell.

31. A case according to claims 20 or 21 wherein the housing shell includes a floor having at least one upward-pointing, parallel stop rib, said stop rib limiting the opening pivoting angle of the first holding part toward the rear in the direction of the lid.

32. A case according to claims 20 or 21 wherein a plurality of stop ribs disposed at a distance from one another are provided in the frontal area of the floor of the housing shell, close to at least one of the lateral walls, said case further including a length stop that is adjustably mounted at selected positions along the major dimension of the housing shell, said length stop cooperating with said stop ribs to form a longitudinal stop for elongate objects that are inserted into the holding parts.

33. A case according to claims 20 or 21 wherein the second holding part has one lower snap-on device that is oriented toward the first holding part, said snap-on device engaging an axis stub on the interior side of the first holding part, said snap-on device extending through a slot in the frontal wall of the first holding part.

34. A case according to claims 20 or 21 wherein a tongue is disposed on the upper pivotable part of said second holding part, said tongue having an elongated hole that snaps onto a snap-on nub that is on the interior side of the lateral wall of the first holding part, said tongue extending through a slot in the frontal wall of the first holding part.

35. A case according to claims 20 or 21 wherein the first and second holding parts further include lower break-throughs, said first and second holding parts also having a plurality of slot pairs, with the upper and lower slots being disposed in series in the insertion direction of the tools, and with the lower slots being disposed in the area of a retaining link, and wherein inward-pointed , resilient clamping tongues are constructed in the area of the lower break-throughs, said clamping tongues protruding into the insertion path of the respective drill and clamping the drill into place.

36. A case according to claims 20 or 21 wherein at least the housing shell, the lid, and the first and second holding parts are constructed from a synthetic material.

37. A case according to claim 36 wherein the housing shell and the lid are constructed from ABS material, and the first and second holding parts are constructed from polypropylene.

38. A case according to claims 20 or 21 wherein the hinge between the housing shell and the lid comprises a film hinge that is made of polyamide.

39. A case for holding elongate objects, said case comprising:

a housing shell;

a lid that is pivotally connected to said housing shell by a hinge, and;

at least two pivotable holding parts that are swiveled inward into the interior of the case at times when the case is closed and that are swiveled outward from the interior of the case at times when the lid is being opened, wherein;

a first holding part that is closest to the lid includes a nub and a first axis stub and a second axis stub, said first holding part being mounted to the housing shell on said axis stubs and wherein;

at least a second holding part is disposed on the side of the first holding part that is away from said lid, said second holding part having an axis stub and a nub disposed thereon, said second holding part also having a snap-on device that engages the second axis stub of the first holding part to detachably connect the second holding part to said first holding part, said second holding part also having a tongue with an elongated hole that slidingly engages the nub of the first holding part.

40. A case for holding elongate objects, said case comprising:

a housing shell;

a lid that is pivotally connected to said housing shell by a hinge, and;

two pivotable holding parts that are swiveled inward into the interior of the case at times when the case is closed and that are swiveled outward from the interior of the case at times when the lid is being opened, wherein;

a first holding part that is closest to the lid includes a nub and a first axis stub and a second axis stub, said first holding part being mounted to the housing shell on said axis stubs and wherein;

a second holding part is disposed on the side of the first holding part that is away from said lid, said second holding part having a snap-on device that engages the second axis stub of the first holding part to detachably connect the second holding part to said first holding part, said second holding part also having a tongue with an elongated hole that slidingly engages the nub of the first holding part.

* * * * *

UNITED STATES PATENT AND TRADEMARK OFFICE

CERTIFICATE OF CORRECTION

PATENT NO. : 7,255,229 B2
APPLICATION NO. : 11/340283
DATED : August 14, 2007
INVENTOR(S) : Peter Roesler It is certified that error appears in the above-identified patent and that said Letters Patent is hereby corrected as shown below:

Column 9, line 5, Claim 6, “claim wherein” should read --claim 4 wherein--

Column 9, line 7, Claim 7, “claim wherein” should read --claim 4 wherein--

Column 11, line 22, Claim 35, “inward-pointed ,” should read --inward-pointed,--

Signed and Sealed this

Fourth Day of December, 2007

JON W. DUDAS
*Director of the United States Patent and Trademark Office*